US012274376B2

(12) United States Patent
Andersen

(10) Patent No.: US 12,274,376 B2
(45) Date of Patent: Apr. 15, 2025

(54) CHILD'S SEAT AND HARNESS

(71) Applicant: Jesper Birk Andersen, Kowloon (CN)

(72) Inventor: Jesper Birk Andersen, Kowloon (CN)

( * ) Notice: Subject to any disclaimer, the term of this patent is extended or adjusted under 35 U.S.C. 154(b) by 83 days.

(21) Appl. No.: 18/121,892

(22) Filed: Mar. 15, 2023

(65) Prior Publication Data

US 2023/0292935 A1 Sep. 21, 2023

(30) Foreign Application Priority Data

Mar. 16, 2022 (GB) ..... 2203608

(51) Int. Cl.
*A47D 15/00* (2006.01)
*A47D 1/00* (2006.01)

(52) U.S. Cl.
CPC ..... *A47D 15/006* (2013.01); *A47D 1/00* (2013.01)

(58) Field of Classification Search
CPC ..... A47D 15/006; A47D 1/00; B60N 2/265; B60N 2/2812; B60N 2/2816; B60N 2/2818; B60N 2002/2815
See application file for complete search history.

(56) References Cited

U.S. PATENT DOCUMENTS 4,790,601 A * 12/1988 Burleigh ..... B60N 2/286 297/484
5,580,126 A * 12/1996 Sedlack ..... B60N 2/265 297/250.1
6,626,493 B2 * 9/2003 Kain ..... B60N 2/2878 297/484
6,799,807 B1 * 10/2004 Chen ..... B60N 2/2812 297/484
7,547,065 B2 * 6/2009 Barger ..... B60N 2/2812 297/483
8,783,782 B2 * 7/2014 Park ..... B60R 22/32 297/475
D911,051 S 2/2021 Gronlund et al.
11,202,518 B1 12/2021 Lo

FOREIGN PATENT DOCUMENTS

EP 1564065 A2 * 8/2005 ..... B60N 2/2812
WO 2013184007 A1 12/2013

OTHER PUBLICATIONS

Great Britain Search Report of Great Britain Application No. GB2203608.1 dated Aug. 15, 2022, 2 pages.
(Continued)

*Primary Examiner* — Milton Nelson, Jr.
(74) *Attorney, Agent, or Firm* — Lippes Mathias LLP

(57) ABSTRACT

Child's seat and harness, the seat having an open front and a rear back support and sides which meet a base, the harness including a pair of shoulder straps and a pair of waist straps connected together at forward ends by a buckle and at rearward ends by a bracket, the bracket including a front side and a rear side, and an anchoring element in the form of a slot through which the strap passes and in which the strap includes an secured end which cannot pass through the slot for anchoring the rearward ends of the straps to the bracket, the straps extending from the front side of the bracket, and a cover plate is provided which is secured to the rear side of the bracket and covers the secured ends of the anchoring element. The straps may combine to form a single strap or remain separate.

17 Claims, 8 Drawing Sheets

(56) References Cited

OTHER PUBLICATIONS (AMAZON), Jan. 27, 2022, "Ziza Highchair and Tray", Amazon.co.uk, Available from: http://www.amazon.co.uk/Ziza-Highchair-Toddlers-Scandinavian-Essential/dp/B09B2PM7S?ref_=ast_sto_dp&th=1, 7 pages.
(SMITH), Feb. 22, 2022, "Ziza's highchair and tray is the adaptable seat that grows with your tot", independent.co.uk, [online], Available from: https://www.independent.co.uk/extras/inybest/kids/baby-tech-essentials/ziza-highchair-and-tray-review-b2020525.html, 7 pages.
(Safe and Care Co), Oct. 21, 2021, "Ziza Seat User Manual", Safeandcareco.com, [online], Available via "User Guide" link at: http://safeandcareco.com/product/ziza-seat-creamy/, 9 pages.
(Safe and Care Co), Oct. 21, 2021, "Ziza Seat-Creamy", Safeandcareco.com, [online], Available from: https://web.archive.org/web/20211021103107/https:/safeandcareco.com/product/ziza-seat-creamy/, 1 page.
Great Britain Search Report of Great Britain Application No. GB2214253.3 dated Mar. 8, 2023, 2 pages.

* cited by examiner

CHILD'S SEAT AND HARNESS

CROSS-REFERENCE TO RELATED APPLICATIONS

This application claims priority under 35 U.S.C. § 119, and the benefit of Great Britain Patent Application No. 2203608.1, filed Mar. 16, 2022 and titled "CHILD'S CHAIR OR HIGHCHAIR", the entirety of which application is hereby incorporated by reference as is fully set forth herein.

FIELD OF THE INVENTION

The present invention relates to a child's seat and harness, and more particularly, to a child's seat and harness with the harness being removable and having a coverable mounting bracket for securing harness in position.

DESCRIPTION OF THE PRIOR ART

Child seats such as those forming the seat part of high-chairs provide a safe pace for a small child to sit at the level of a table in the company of others at the table and need a restraining harness for the child to prevent the child form climbing or falling from the height of the height chair. Such harnesses are known from, for example WO2018/173283, which discloses a child seat and harness which includes position adjustment of the harness as the child grows.

A problem arises with such harness and seat arrangements in that they are difficult to clean. During mealtimes a lot of food can be distributed over the entire set and collect in the crevasses created by the slots in the swat through which the harness straps pass. These leads to an arduous cleaning task after every meal. Furthermore research has determined that generally as small child grows it becomes significantly more agile and aware and is safe to sit in the child's seat without a harness, but the child is still small enough to need the benefit of the additional height at the table. In such cases the harness tends to be left in place unused because it is difficult to remove and can become a trap for dirt and germs and the cleaning task is still necessary and as arduous.

Thus, it is an objective of the present invention to provide a child's set and harness that overcomes these problems.

SUMMARY OF THE INVENTION

The present invention provides a child's seat and harness, such as would be used for a high chair, the seat having an open front and a rear back support and extending forwardly therefrom inclined sides which meet a seat base, the harness including a pair of shoulder straps, and a pair of waist straps connected together at their forward ends by a buckle and at their rearward ends by a bracket securely located in the rear back support and said bracket comprising a front side and a rear side, and at least one anchoring means for anchoring the rearward ends of the straps to the bracket which extend from the front side of the bracket, and wherein a cover plate is provided which is secured to the rear side of the bracket and covers the anchoring means.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
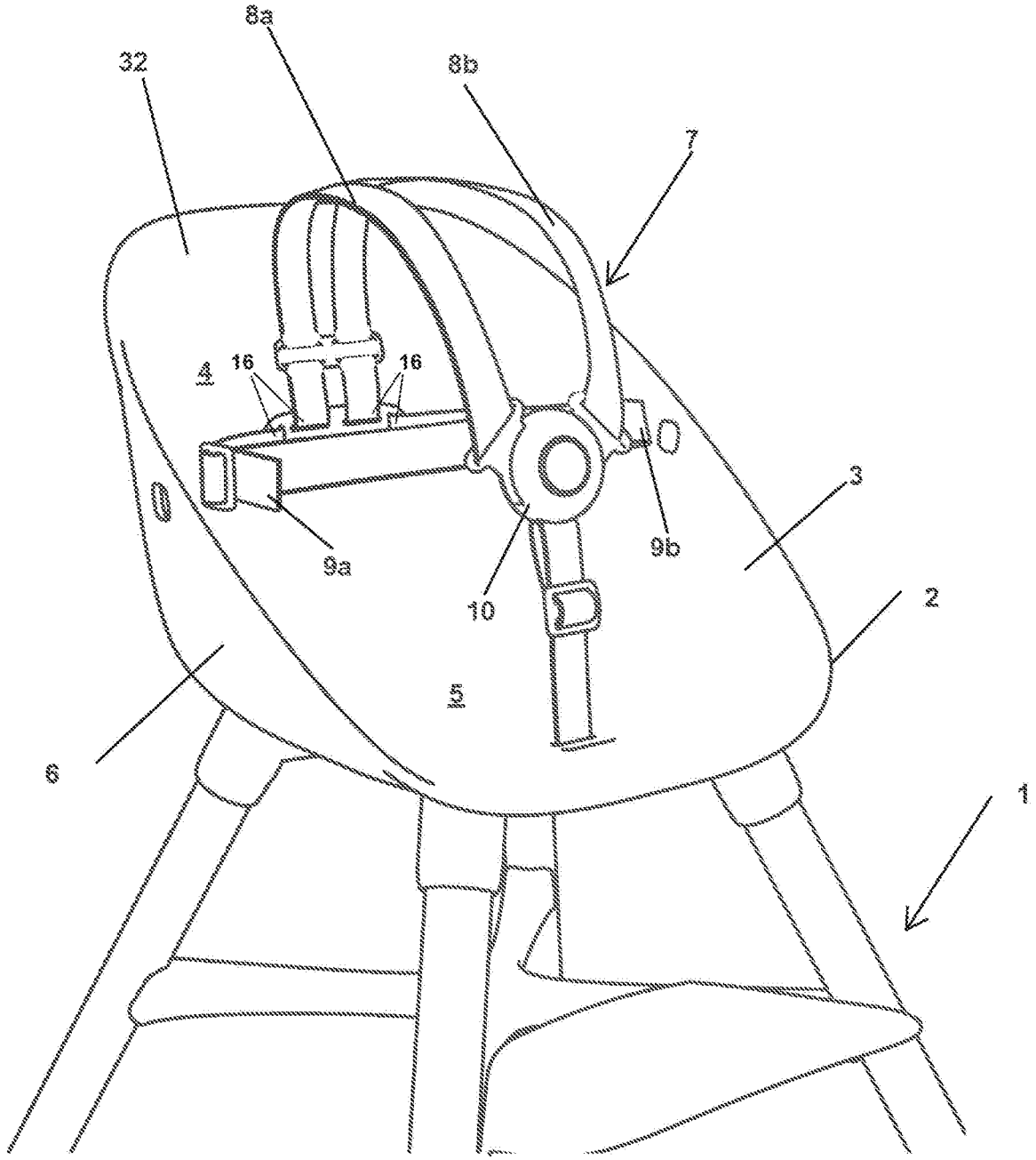
FIG. 1 is a perspective view of a child's seat and harness according to a first embodiment of the present invention.
Figure 2:
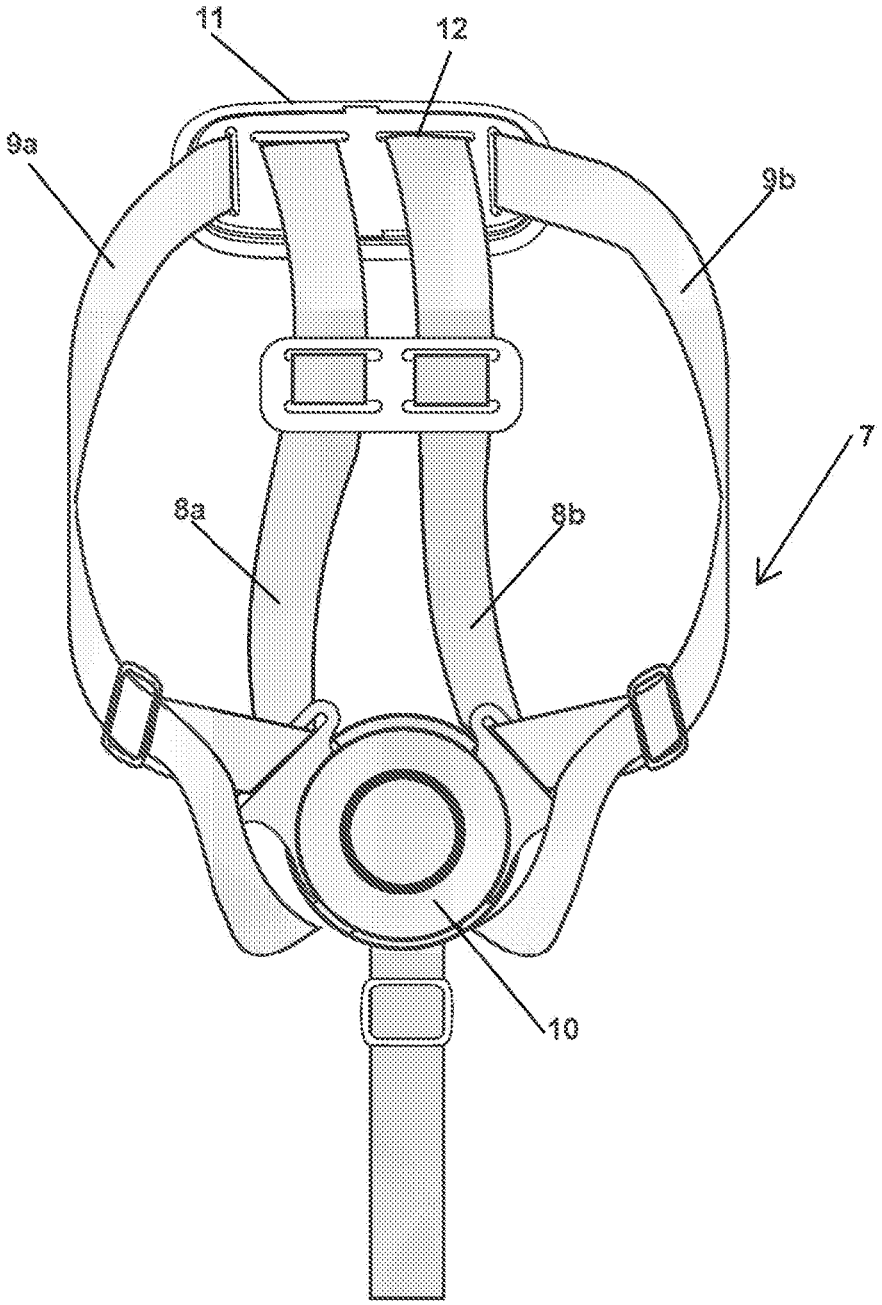
FIG. 2 is a perspective view of the harness according to the first embodiment of the present invention.

In FIG. 1 is shown a perspective view of a child's seat and harness, such as would be used for a high chair 1, the seat 2 having an open front 3 and a rear back support 4 and extending forwardly therefrom inclined sides 6 which meet a seat base 5, the harness 7 including a pair of shoulder straps 8*a*, 8*b*, and a pair of waist straps 9*a*, 9*b* connected together at their forward ends by a buckle 10 and at their rearward ends by a bracket 11 securely located in the rear back support 4 and said bracket 11 comprising a front side 12 and a rear side 13, and at least one anchoring means 14 for anchoring the rearward ends of the straps 8*a*, 8*b*, 9*a*, 9*b* to the bracket 11 which extend from the front side 12 of the bracket 11. Cover plate 15 is provided which is secured to the rear side 13 of the bracket 11 and covers the anchoring means 14.

Figure 3:
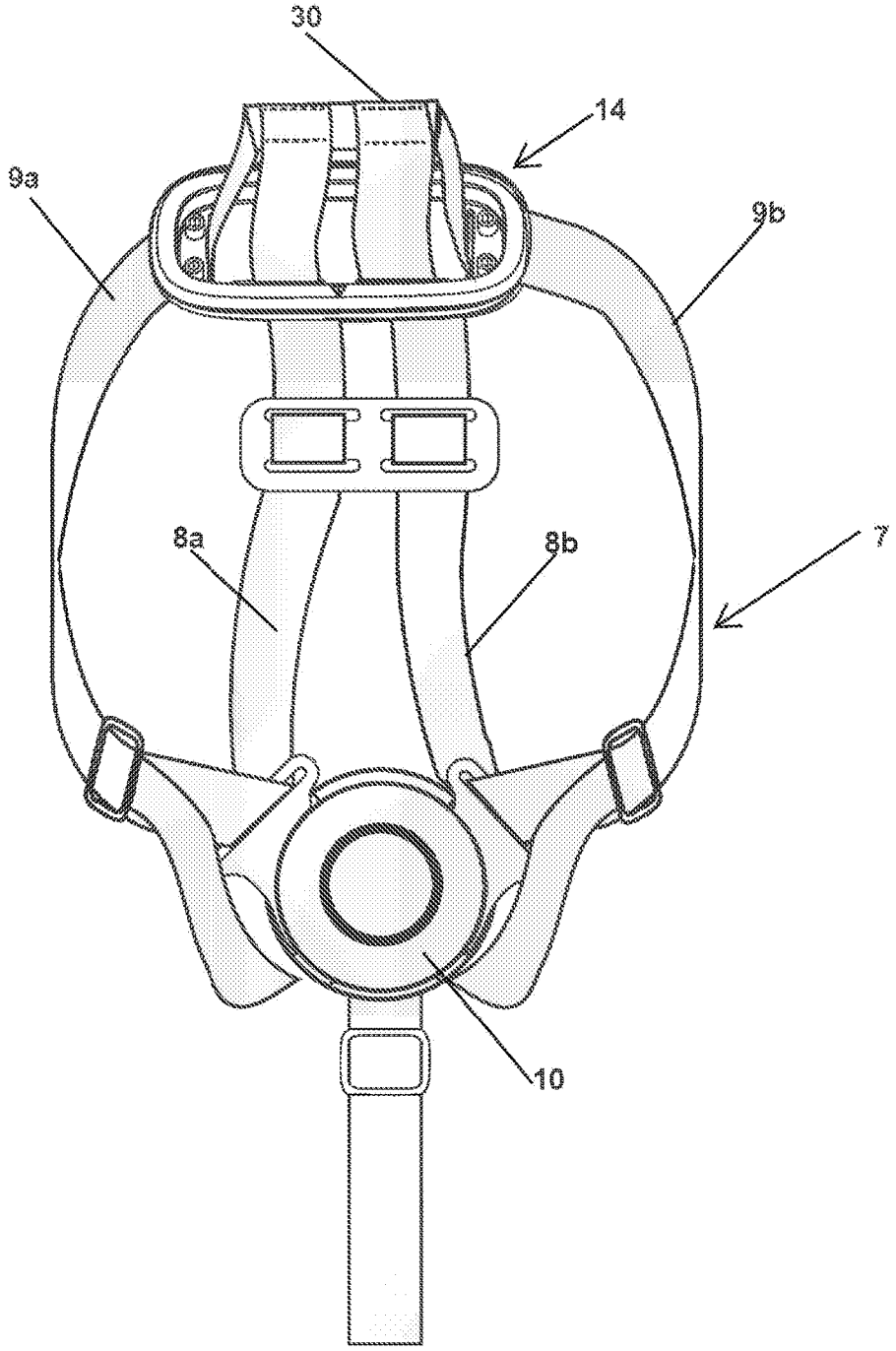
FIG. 3 is a perspective view of the harness showing the rear of the bracket according to the first embodiment of the present invention.

Referring to FIG. 3 it can be seen that the anchoring means 14 is formed by the combination of the slots 14*a*, 14*b*, 14*c*, 14*d* in the bracket 11 and the straps 8*a*, 8*b*, 9*a*, 9*b*. In this embodiment straps 8*a* and 8*b* form a continuous strap which is threaded through the parallel slots 14*c*, 14*d* of the bracket 11 from the front side 12 to the rear side 13 through slot 14*c* and then back through slot 14*d* from the rear side 13 out through the front side 12. The ends of straps 9*a*, 9*b* are threaded through series slots 14*a*, 14*b* and permanently attached to the portion of straps 8*a*, 8*b*, that is located in the bracket between parallel slots 14*c*, 14*d* by stitching 30 during manufacture. Thus when the straps 8*a*, 8*b*, 9*a*, 9*b* are pulled forwardly they are securely restrained against the rear side 13 of the bracket 11 and cannot penetrate the slots 14*a*, 14*b*, 14*c*, 14*d*.

It will be appreciated that alternative forms of harness securement may be envisaged. The anchoring means 14 may, in an alternative embodiment (not shown), be in the form of one slot 14*a* through which the end of each strap 8*a*, 8*b*, 9*a*, 9*b* passes and in which each strap 8*a*, 8*b*, 9*a*, 9*b* includes an secured end 16, so that it cannot pass through the corresponding slot 14*a*, 14*b*, 14*c*, 14*d* thus securely retaining the straps 8*a*, 8*b*, 9*a*, 9*b* to the bracket 11. Thus the anchoring means 14 include the slots and secured portion of the strap which work together to anchor the straps of the harness to the bracket 11. A simple way of enlarging the strap thickness is to fold over the end of the strap and stitch the end securely to the strap, thus providing a doubling of the thickness which is sufficient to be prevented from passing thorough the corresponding slots.

In an alternative embodiment (not shown) the straps 8*a*, 8*b*, 9*a*, 9*b* may combine to form a single strap which passes through a single slot 14*a*, the single strap including an enlarged end which retains the single strap and thus the straps 8*a*, 8*b*, 9*a*, 9*b* to the bracket 11.

In a further alternative embodiment of the invention (not shown) the straps 8*a*, 8*b*, 9*a*, 9*b* may combine to form two straps which passes through two corresponding single slots 14*a*, 14*b*, each of the two straps includes an enlarged end which retains the single strap and thus the straps 8*a*, 8*b*, 9*a*, 9*b* to the bracket 11. Straps 8*a*, 8*b* may form a single strap which passes through the slots 14*c*, 14*d*, entering in slot 14*c* and exiting slot 14*d*. Similarly for straps 9*a*, 9*b*.

Figure 4:
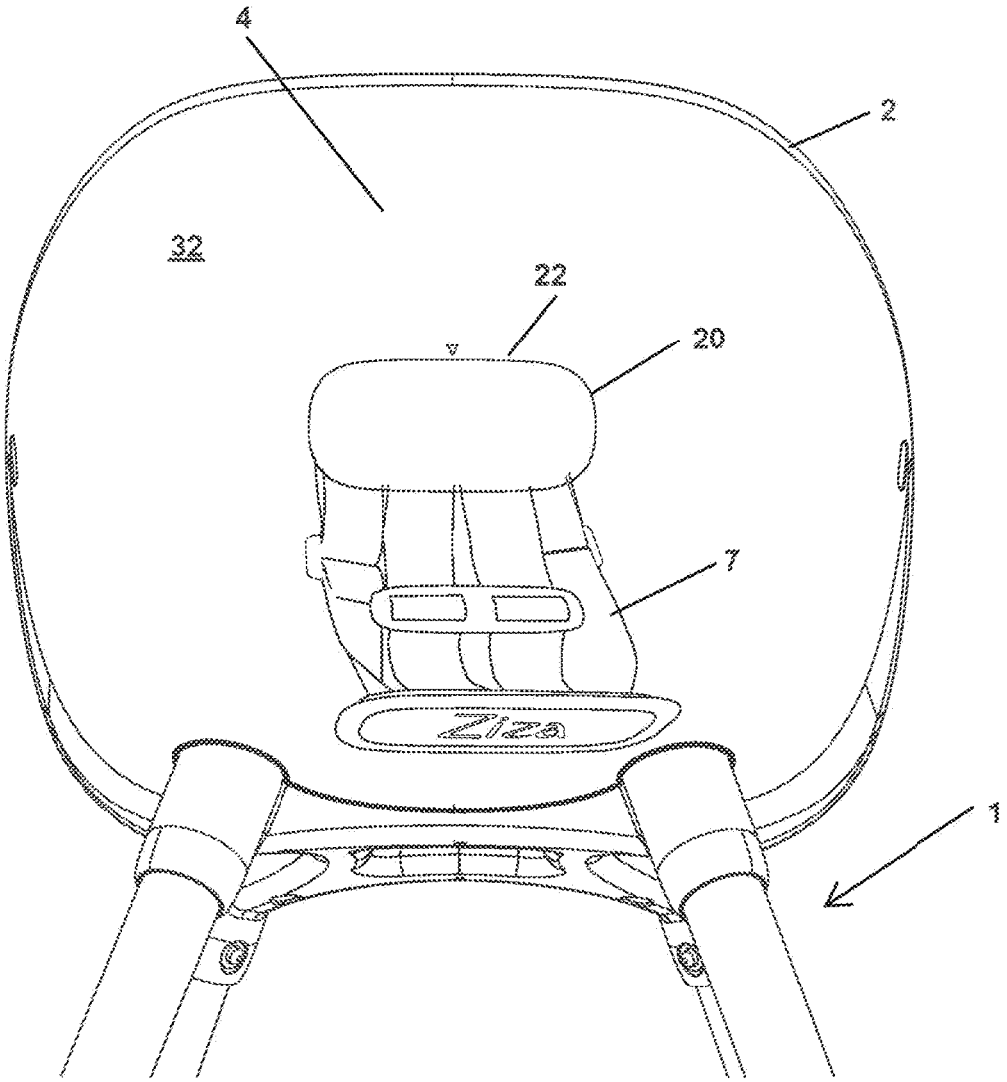
FIG. 4 is a rear view of the child's seat according to the first embodiment of the invention with the harness being removed.
Figure 5:
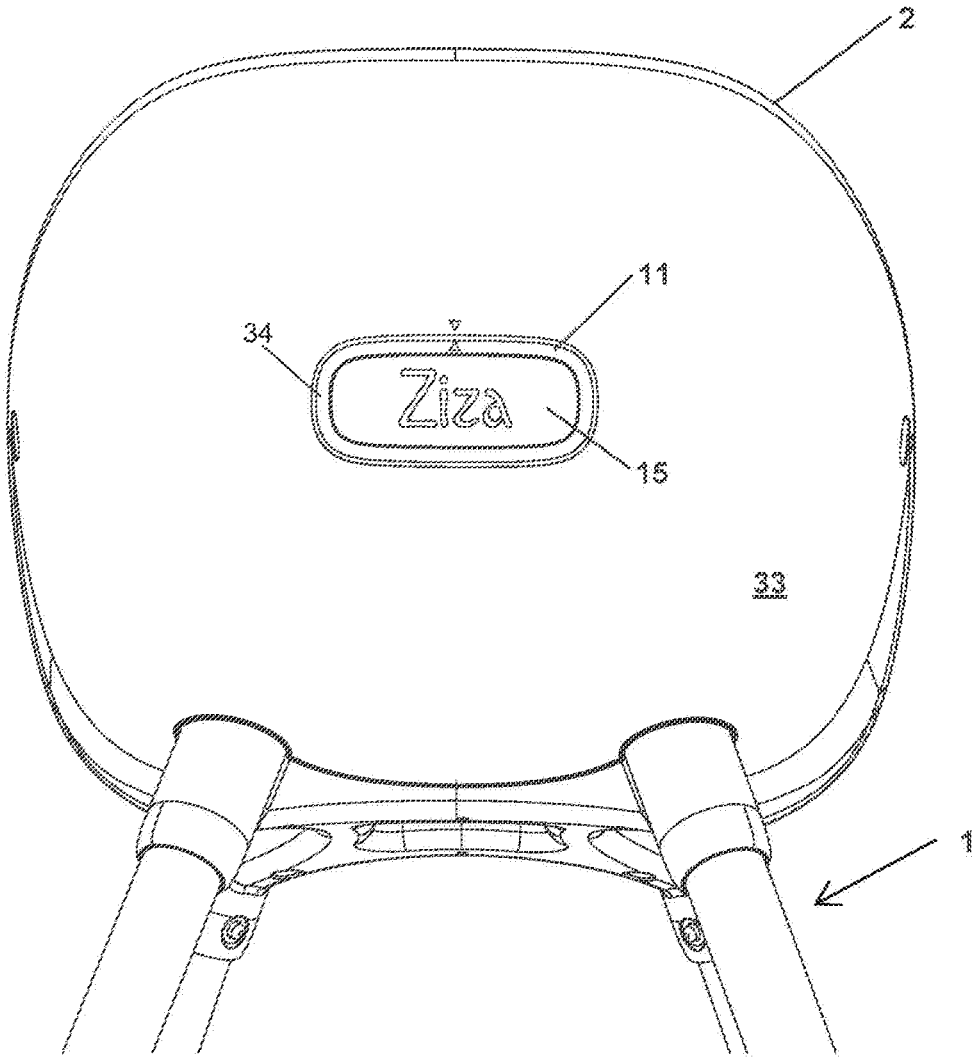
FIG. 5 is a rear view of the child's seat according to the first embodiment of the invention with the harness secured in situ.

FIG. 4 shows an isometric view of the rear of the seat 2 of a highchair 1, with the harness 7 and bracket 11 removed showing the opening 20 having an inside edge 22 with a thickness that corresponds to the gap between the flange 31 of the bracket 11 and the detents 29.

Figure 6:
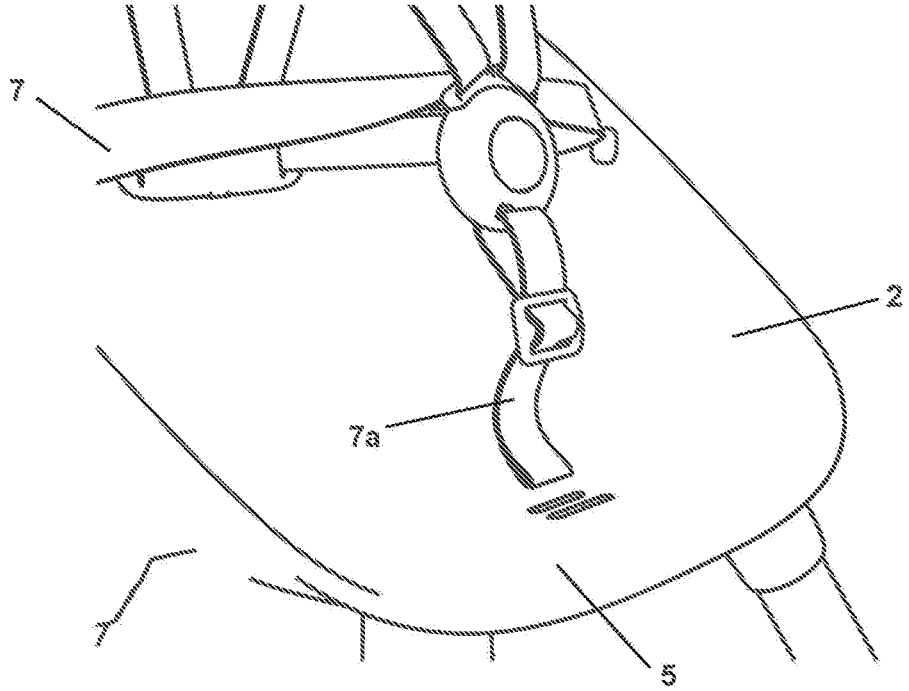
FIG. 6 is a front perspective view of the child's seat showing the fitting of the front end of the harness.
Figure 7:
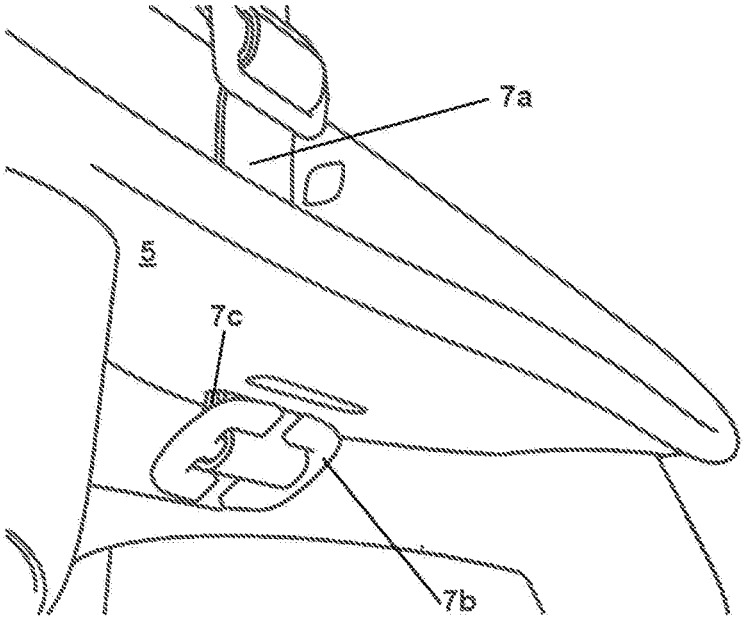
FIG. 7 is a front perspective view of the child's seat showing the front end of the harness in the fitted position.
Figure 8:
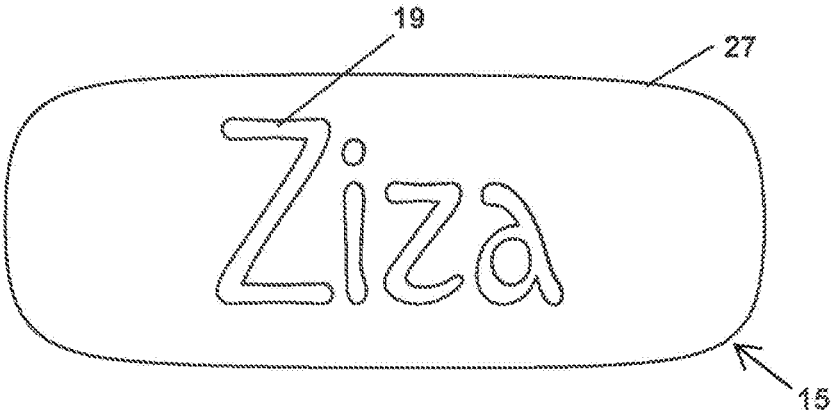
FIG. 8 is an outside view of the cover plate according to the first embodiment of the invention.

FIGS. 6 and 7. show isometric views of the front of the set with the harness 7 comprising a crotch strap 7*a* which extends from the buckle 10 and includes a conventional strap buckle 7*b* which is used to lock the strap 7*a* under neath the seat base 5 to secure the harness 7. In a commonly known way of detaching a harness the strap buckle 7*b* is slim enough to pass through the slot 7*c* in the seat base 5. It can be seen that it would be also possible to use the removable bracket 11 of the present invention for this mounting of the crotch strap 7*a* to the seat base 5 to avoid the use of the narrow slots in the seat and to make is easier for the user to release the harness and clean the seat 2. The skilled person will be able to envisage using the harness attachment concept of the invention for attaching a harness in any position on a seat.

Figure 11:
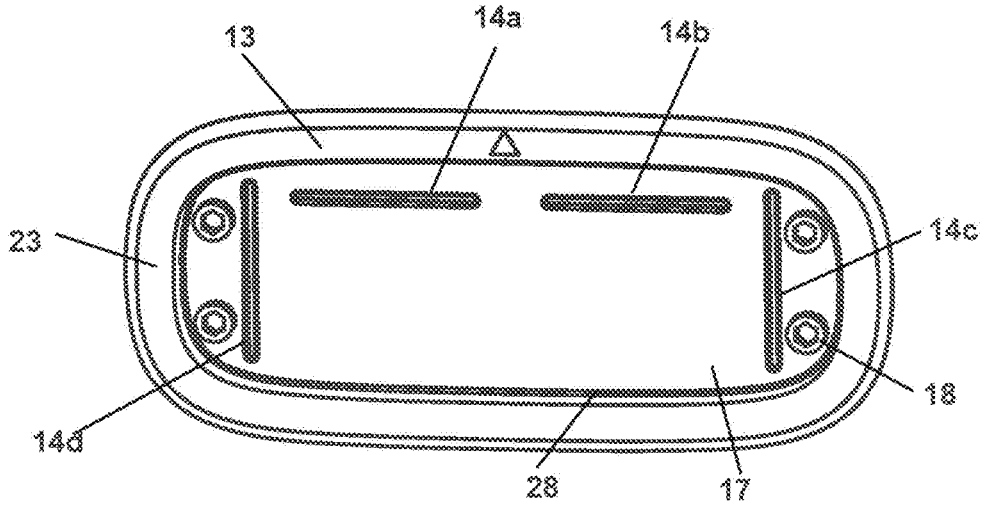
FIG. 11 is a rear view of a securing bracket of the child's seat according to the first embodiment of the invention with a cover plate removed.
Figure 12:
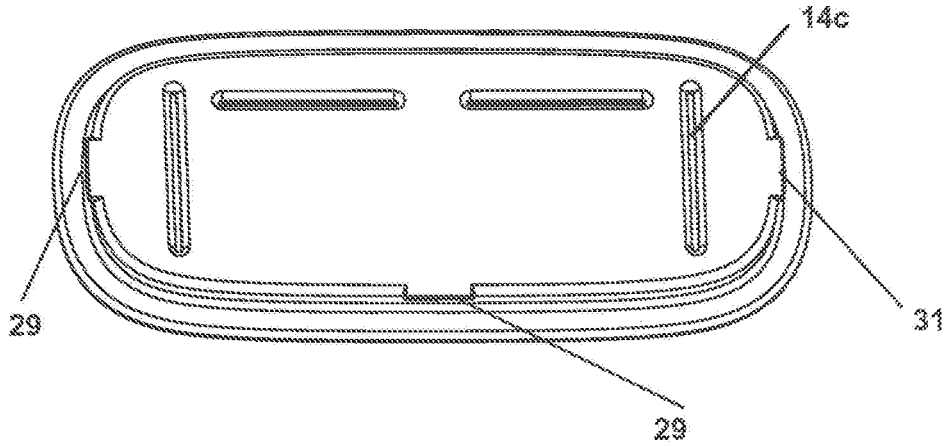
FIG. 12 is a front view of a securing bracket of the child's seat according to the first embodiment of the invention.
Figure 13:
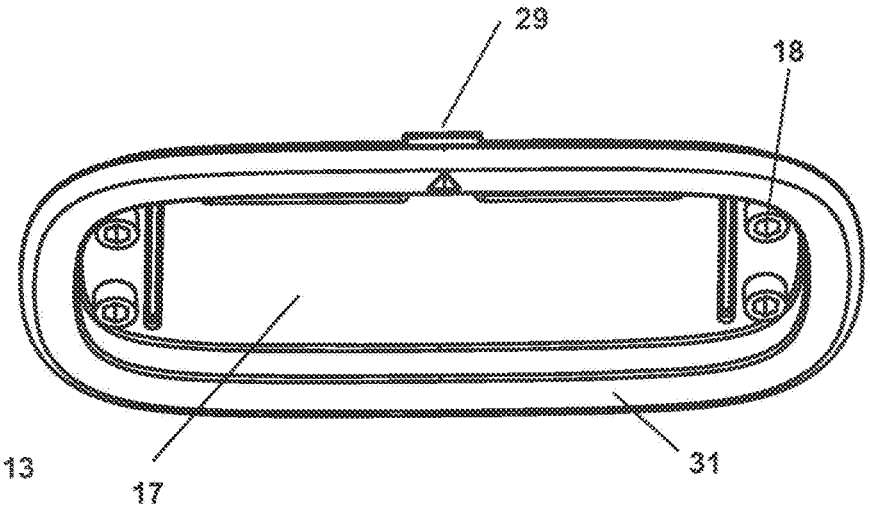
FIG. 13 is a rear perspective view of the securing bracket of the child's seat according to the first embodiment of the invention.

Referring particularly to FIGS. 11 to FIG. 13, the rear side 13 of the bracket 11 includes a recess 17 formed by surrounding rim 23 in which the secured ends 16 are located. The height of the rim 23 is dimensioned to provide enough space in the recess 17 to contain the secured ends 16.

The rear side 13 of the bracket 11 includes support means 18 in the form of four upstanding posts located inside the recess 17 for attachment of a cover plate 15.

Figure 9:
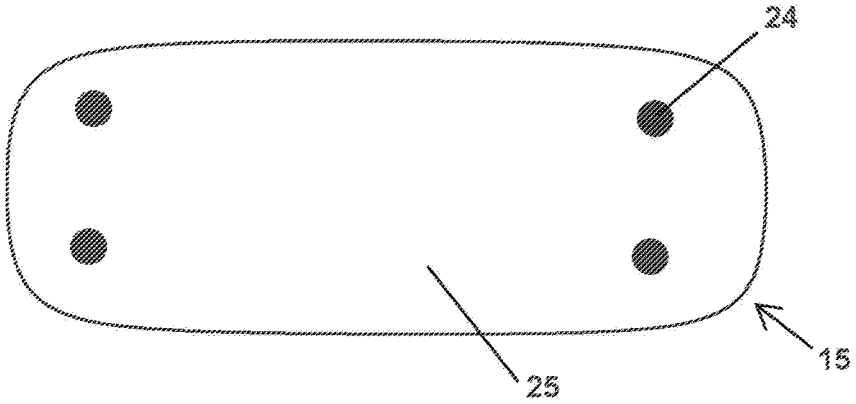
FIG. 9 is an inside view of the cover plate according to the first embodiment of the invention.
Figure 10:
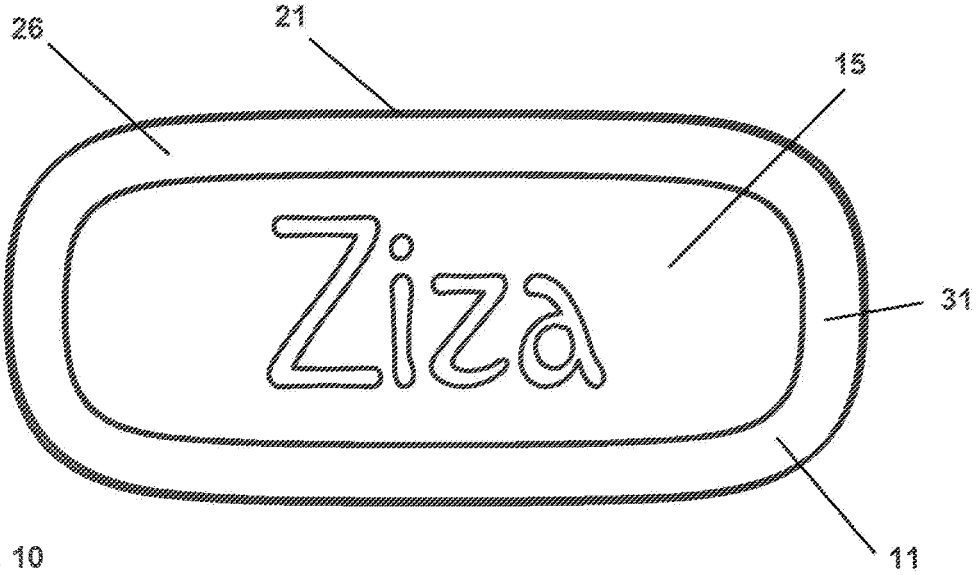
FIG. 10 is an outside view of the cover plate fitted to the bracket according to the first embodiment of the invention.

As shown in FIG. 9, the cover plate 15 includes four corresponding abutments 24 extending from its inside surface 25 which align with the upstanding posts 18 when the cover plate 15 is located in position. The location of the cover plate 15 is defined by the shape of the outside edge 27 which corresponds with the inside edge shape 28 of the rim 23 of the bracket 11. The abutments 24 are welded to the top surfaces of the corresponding upstanding posts 18 to secure the cover plate 15 permanently to the bracket 11.

In alternative embodiment it is appreciated that the support means 18 may comprise as few as two upstanding posts 18 to which the cover plate 15 is secured so creating more space between the rear side 13 of the bracket 11 and the cover plate 15 between the upstanding posts 18 in which the secured ends 16 are located.

By means of this particular construction the outside surface 26 of the cover plate 15 forms a smooth flat surface which is easy to wipe clean and provides a surface on which information tailored to a particular audience may be presented such as a brand or mark 19. Thus all the components of the seat 2 and harness 7 and the highchair 1 may be made in one geographical location and the cover plate 15 in any number of variations of surface forms can be fitted in a number of alternative locations. This enables significant scale in the production of the majority of the components, and easy local adaptation.

Furthermore, the outside perimeter of the cover plate 15 includes a rounded edge 34 so that a smooth transition is provided between the contour as the seat outside surface 33 of the rear back support 4 of the seat 2 and the bracket outside surface 26, so forming a continuous smooth cleanable surface without any grooves or protrusions in which dirt can accumulate.

The bracket 11 is located in a correspondingly shaped opening 20 in the rear back support 4 of the seat 2. Whereas the cover plate is permanently secured to the bracket 11 by welding, the bracket 11 on the other hand is removably secured to the rear back support 4.

The outside perimeter 21 of the bracket 11 includes a flange 31 on its rear side 13 that is larger than the and the inside edge 22 of the opening 20 and includes detents 29 on its front side 12 which are dimensioned to securely attach the bracket 11 to the rear back support 4 in the opening 20 during normal use, but which can be released by applying sufficient pressure by an adult to remove the bracket 11 and the harness 7 from the opening 20 and thus from the seat 2 when not in use.

In this embodiment four detents 29, as shown in FIGS. 12 and 13, are arranged on the outside perimeter 21 of the bracket 11, each being between 8 to 12 mm long and engaging against the seat inside surface 32 of the rear back support 4 and the outside perimeter of the bracket 11 also comprising the flange 31 which extends outwardly to a larger extent than the dimension of the opening 20, such that when fitted, the bracket is securely held in place by an interference fit between the flange 31 bearing against the seat outside surface 33 of the rear back support 4 and the detents 29. Thus the gap between the flange 31 and the detents 29 corresponds to the thickness to the rear back support 4 in that it is slightly smaller to ensure a tight fit that cannot be easily or accidentally removed when fitted in place.

In an alternative embodiment corresponding recesses (not shown) could be provided in the inside edge 22 of the opening 20. In can be imagined that the same effect could be achieved by detents arranged on the inside edge of the opening 20 and recesses on the outside perimeter of the bracket 11. Also, there could be a continuous recess or groove. The detents and recess(es) being dimensioned in combination with the physical properties of the material of the seat 2 and buckle 11, to ensure that at least a force of 120 newtons is required to remove the bracket 11 from the seat. This is so that it can be ensured that the bracket 11 will not become dislodged during normal use. Whereas when the harness is no longer required, due to the child becoming sufficient old to no longer need a harness, it can be removed by the adult user providing a sufficiently large force of 120 newtons against the bracket inside surface pushing outwardly to dislodge the detents 29 from engagement against the seat inside surface 25 to dislodge the bracket 11 from the opening 20. The entire harness can then be removed.

It is also possible to re-fit the bracket by reversing the process and pressing the bracket 11 forwardly against the rear back support with the bracket aligned with the opening 20, using the same required force until the detents click into position once more bearing against the seat inside surface. This is useful when the harness is soiled for example by accumulation of food during the child's mealtimes, and it can be removed to be thoroughly washed and replaced when clean. The seat back support 4 and the entire seat 2 can correspondingly easily thoroughly cleaned.

It can be seen from the drawings that the bracket 11 and opening 20 are correspondingly lozenge shaped, being elongate in the horizontal direction, and the slots 14 arranged as shown, as being the preferred embodiment, but that any suitable shape or arrangement of slots could be chosen to enable the working of the invention albeit in a less than optimal way.

Those skilled in the art will readily observe that numerous modifications and alterations of the device may be made while retaining the teachings of the invention.

COMPONENT LIST

1. High chair
2. Seat
3. Open front
4. Rear back support
5. Seat base
6. Sides
7. Harness, 7*a* crotch strap, 7*b* strap buckle, 7*c* slot
8. Straps collectively, 8*a*, 8*b* Shoulder straps
9. Straps collectively, 9*a*, 9*b* Waist straps
10. Buckle
11. Bracket
12. Front side
13. Rear side
14. Anchoring means, slots collectively, 14*a*, 14*b*, 14*c*, 14*d* Slots
15. Cover plate
16. Secured ends
17. Recess
18. Support means, upstanding posts
19. Mark or brand
20. Opening
21. Outside perimeter
22. Inside edge.
23. Rim
24. Abutments
25. Bracket inside surface
26. Bracket outside surface
27. Inside edge
28. Outside edge
29. Detent
30. Stitching
31. Flange
32. Seat inside surface
33. Seat outside surface
34. Rounded edge

The invention claimed is:

1. A child's seat and harness, the seat having an open front and a rear back support and extending forwardly therefrom inclined sides which meet a seat base, the harness including a pair of shoulder straps and a pair of waist straps connected together at their forward ends by a buckle and at their rearward ends by a bracket securely located in the rear back support and said bracket comprising a front side and a rear side, and at least one anchoring means for anchoring the straps to the bracket, wherein a cover plate is provided which is secured to the rear side of the bracket and covers the anchoring means.

2. A child's seat and harness according to claim 1, wherein the anchoring means is in the form of at least one slot through which at least one of the straps passes and a secured end of the at least one strap which cannot pass through the slot, thus securely retaining the strap to the bracket.

3. A child's seat and harness according to claim 2, wherein the straps comprise a single waist strap which passes through first slots so that the single waist strap includes an inside section extending on the rear side of the bracket, and the straps further comprise shoulder straps that pass through second slots and are securely attached to the inside section of the single waist strap and thus to the bracket.

4. A child's seat and harness according to claim 2, wherein the straps combine to form two straps which passes through two corresponding single slots, each of the two straps includes a secured end which retains the single strap and thus the straps to the bracket.

5. A child's seat and harness according to claim 2, wherein the straps pass through corresponding slots, and each strap includes a corresponding secured end which retains the straps to the bracket.

6. A child's seat and harness according to claim 2, wherein the rear side of the bracket includes a recess in which the at least one secured end is located.

7. A child's seat and harness according to claim 1, wherein the rear side of the bracket includes support means for the cover plate, the support means comprising at least two upstanding posts to which the cover plate is secured so creating a space between the rear side of the bracket and the cover plate between the upstanding posts in which the rearward ends of the pair of shoulder straps and the rearward ends of the pair of waist straps are located.

8. A child's seat and harness according to claim 1, wherein the bracket is located in a correspondingly shaped opening in the rear back support of the seat.

9. A child's seat and harness according to claim 1, wherein the rear side of the bracket includes support means for the cover plate.

10. A child's seat and harness according to claim 9, wherein the outside surface of the cover plate forms a smooth flat surface which is easy to wipe clean and provides a surface on which information tailored to a particular audience may be presented.

11. A child's seat and harness according to claim 9, wherein the outside surface of the cover plate follows the same contour as the rear side of the bracket so forming a continuous smooth cleanable surface without any grooves or protrusions in which dirt can accumulate.

12. A child's seat and harness according to claim 11, wherein the bracket includes a flange with a rounded edge which provides a smooth transition between the rear side of the bracket and an outside surface of the seat to facilitate cleaning.

13. A child's seat and harness according to claim 12, wherein the bracket is removably secured to the rear back support.

14. A child's seat and harness according to claim 13, wherein at least one detent is provided, being between 8 to 12 mm long.

15. A child's seat and harness according to claim 13, wherein the bracket is located in a correspondingly shaped opening in the rear back support of the seat and an outside perimeter of the bracket comprises detents which act against an inside edge of the opening to securely attach the bracket to the rear back support during normal use, wherein the bracket can be released from the rear back support by application of sufficient pressure by an adult to remove the bracket and the harness from the seat when not in use.

16. A child's seat and harness according to claim 1, wherein the bracket and opening are correspondingly lozenge shaped, being elongate in the horizontal direction.

17. A child's seat and harness according to claim 9, wherein the cover plate is welded to the support means.

* * * * *